US005774981A

United States Patent [19]

Maejima et al.

[11] Patent Number: 5,774,981

[45] Date of Patent: Jul. 7, 1998

[54] TERMINAL INSERTION METHOD AND APPARATUS

[75] Inventors: Takamichi Maejima; Hiroo Suzuki, both of Haibara-gun, Japan

[73] Assignee: Yazaki Corporation, Tokyo, Japan

[21] Appl. No.: 744,168

[22] Filed: Nov. 5, 1996

[30] Foreign Application Priority Data

Jul. 11, 1995 [JP] Japan ..... 7-288556

[51] Int. Cl.[6] ..... H01R 43/04

[52] U.S. Cl. ..... 29/861; 29/33 M; 29/753; 29/863

[58] Field of Search ..... 29/33 M, 861, 29/863, 754, 747, 753, 857

[56] References Cited

U.S. PATENT DOCUMENTS

| | | | |
|---|---|---|---|
| 5,083,370 | 1/1992 | Koeh et al. | 29/863 |
| 5,127,159 | 7/1992 | Kudo et al. | 29/861 X |
| 5,208,977 | 5/1993 | Ricard | 29/861 |
| 5,309,633 | 5/1994 | Ricard | 29/33 M X |
| 5,315,756 | 5/1994 | Jurjevic et al. | 29/33 M X |
| 5,355,583 | 10/1994 | Osumi et al. | 29/33 M X |
| 5,365,659 | 11/1994 | Ueda et al. | 29/863 |
| 5,414,925 | 5/1995 | Nishide et al. . | |
| 5,477,607 | 12/1995 | Ohta et al. | 29/33 M X |
| 5,515,601 | 5/1996 | Maejima | 29/33 M X |
| 5,575,058 | 11/1996 | Nakamura et al. | 29/33 M X |
| 5,606,795 | 3/1997 | Ohba et al. | 29/863 |
| 5,615,478 | 4/1997 | Celoudoux et al. | 29/33 M X |

FOREIGN PATENT DOCUMENTS

| | | |
|---|---|---|
| 0 440 955 A1 | 12/1990 | European Pat. Off. . |
| 1-313871 | 12/1989 | Japan . |
| 5-31683 | 2/1993 | Japan . |
| 6-84577 | 3/1994 | Japan . |

OTHER PUBLICATIONS

Patent Abstracts of Japan, vol. 014, No. 444, Sep. 21, 1990 & JP 02 177283 A, Jul. 10, 1990.

*Primary Examiner*—Carl J. Arbes

*Attorney, Agent, or Firm*—Armstrong, Westerman, Hattori, McLeland & Naughton

[57] ABSTRACT

Both terminal ends of each of terminal-equipped wires held by clips are simultaneously picked out by a pair of terminal insertion heads individually driven and moved simultaneously moved. Thus, a short terminal-equipped wire can be inserted into different connector housing. In a terminal insertion apparatus comprising a Y-axis beam having a terminal insertion head and moving along a pair of X-axis beams, a pair of driving motors are provided at both ends of said Y-axis beam and are driven synchronously to move said Y-axis beam. Thus, the Y-axis beam is prevented from being vibrated, thereby assuring terminal insertion.

8 Claims, 5 Drawing Sheets

TERMINAL INSERTION METHOD AND APPARATUS

BACKGROUND OF THE INVENTION

1. Field of the Invention

The present invention relates to a terminal insertion method which moves both terminal ends of a terminal-equipped wire to a connector housing(s) simultaneously, and a terminal insertion apparatus for making smooth horizontal movement of a Y-axis beam equipped with a terminal insertion head.

2. Description of the Prior Art

FIG. 6 shows a conventional terminal insertion apparatus 41.

This apparatus 41 includes a clamping rod 45 for clamping plural terminal-equipped wires 42 in a U-shape bent state, a terminal insertion head which can move horizontally along the clamping rod 45 and a receiving jig (not shown) for securing connector housings 47 on a stand 48. In a previous step, the terminals 43 held by the clamping rod 45 are crimped on the tips of each wire 44 by a crimping machine 49. The entire clamping rod 45 is sent to a terminal insertion step. The terminal insertion head 46 has a pair of front and rear holding pieces 50 and 51 which can be moved horizontally and vertically.

On the clamping rod 45, the terminal-equipped wires 42 are arranged in the order of insertion. The insertion head 46 takes off the terminal equipped wire 42 from the clamping rod 45 and moves forward to insert the terminal 43 into the connector housing 47. As shown in FIG. 7, the terminals 43 are inserted into lower chambers 52 of the connector housing 47 in order from the end and thereafter into upper chambers 53 thereof in order. This intends to prevent the upper introducing wire 44 from hindering terminal insertion. After the front holding piece 50 makes insertion of the tip of the terminal 43 primarily, it moves upwards to escape. The rear holding piece 51 makes insertion of the entire terminal secondarily.

The above conventional terminal insertion apparatus, however, has the following disadvantage. As shown in FIG. 8, when the one terminal 43 of the single terminal-equipped wire (circuit) 44 is moved towards the connector housing 47 by the terminal insertion head 46, if the wire 44 is short, it is stretched from the clamping rod 45 clamping the other terminal, thus making it impossible to insert the terminal into the connector housing 47. In this case, only the short terminal-equipped wire 42 must be inserted manually, which leads to an increase in the man of hours in the fabrication of a wire harness.

SUMMARY OF THE INVENTION

In view of the above circumstance, an object of the present invention is to provide a terminal insertion means which can insert a short terminal-equipped wire (circuit) into a connector housing(s) automatically and surely, and also shorten the fabricating time.

In order to attain the above object, in accordance with one aspect of the present invention, there is provided a method of inserting a terminal comprising the steps of: picking out both terminal ends of each of terminal-equipped wires held by a plurality of clips by a pair of terminal insertion heads individually driven; and simultaneously moving both terminal ends of each wire.

In accordance with another aspect of the present invention, there is provided a terminal insertion apparatus comprising: at least one Y-axis beam moving along a pair of X-axis beams each having a rack; a terminal insertion head attached to said Y-axis beam; a pair of driving motors, each having a pinion toothed with said rack, provided at both ends of said Y-axis beam so that they are driven synchronously to move said Y-axis beam.

In accordance with the present invention, both terminal ends of a single terminal-equipped wire can be moved simultaneously from a clip and terminal-inserted simultaneously so that the wire will not be hung on the clip and so not stretched. Thus, even a short terminal-equipped wire can be inserted automatically. This permits the conventional manual insertion to be abolished and the fabrication time to be shortened.

Further, both ends of the Y-axis beam equipped with the terminal insertion head can be driven simultaneously so that the tilt and/or vibration of the Y-axis beam can be prevented. This permits the terminal to be inserted into the housing accurately.

The above and other objects and features of the present invention will be more apparent from the following description taken in conjunction with the accompanying drawings.

DETAILED DESCRIPTION OF THE PREFERRED EMBODIMENTS

A detailed explanation will be given of embodiments of the present invention.

Figure 1:
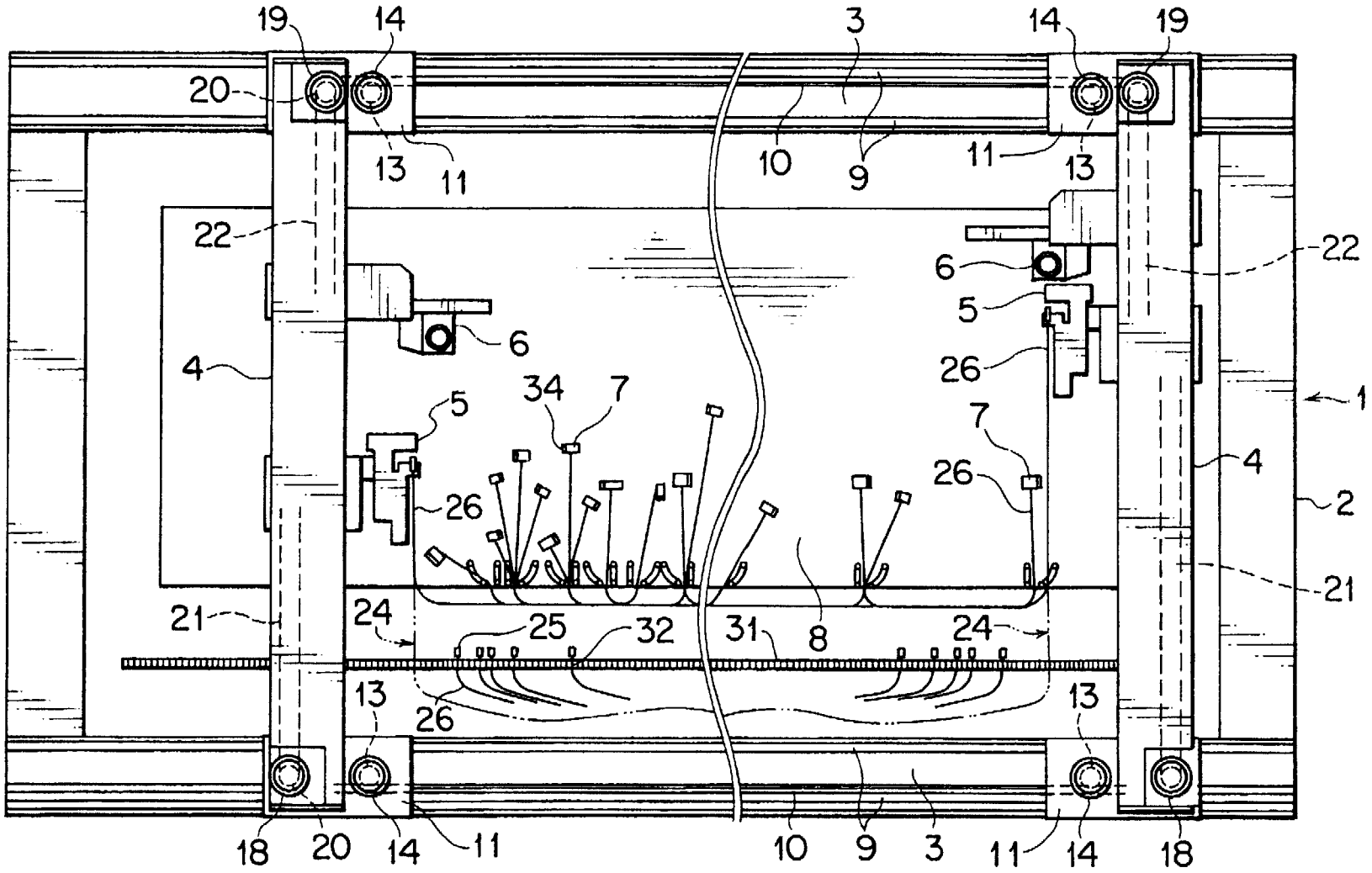
FIG. 1 is a plan view of the entire terminal insertion apparatus according to the present invention.
Figure 2:
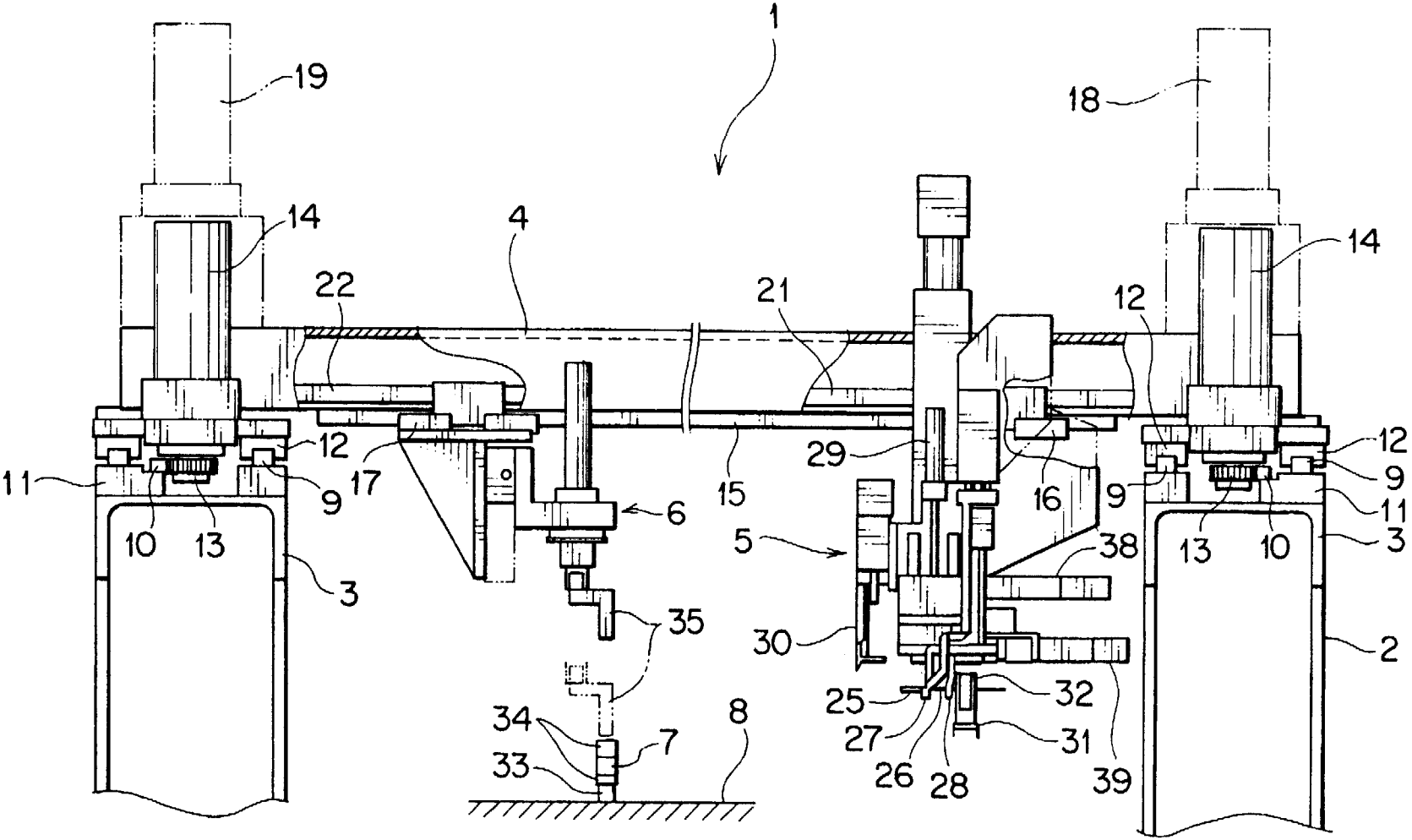
FIG. 2 is a side view of the entire terminal insertion apparatus according to the present invention.

FIGS. 1 and 2 show a terminal insertion apparatus 1 according to the present invention.

This terminal insertion apparatus 1 includes a pair of X-axis beams 3 hung on a frame 2; a pair of Y-axis beams 4 movably hung on the pair of X-axis beams 3; a terminal insertion head 5 and a connector holding unit 6 movably provided at each of the Y-axis beams 4 and base pallet 8 for securing connector housings 7 below the pair of Y-axis beams 4.

The terminal insertion apparatus 1 has a large size because of X-axis beams having a length of about 5 meters and Y-axis beams having a length of 2 meters. On each of the X-axis beams 3 a single rack 10 is arranged in a longitudinal direction between a pair of guide rails 9 provided on both sides. The guide rails and rack 10 are bolted to the X-axis beam 3, respectively. On both ends of each of the Y-axis beams 4, guide plates 11 are provided along the X-axis beams 3. Each guide plate 11 includes LM guides 12 corresponding to the guide rails 9 and a driving servo motor (hereinafter simply referred to as driving motor) 14 having a pinion 13 for the rack 10. The LM guide 12 is slidably engaged with the guide rail 9 and the pinion 13 is toothed with the rack 10 so as to roll on the rack by motor driving. The servo-motors 14 on both sides of the Y-axis beam 4 are driven synchronously.

A guide rail 15 is provided on the lower side of each of the Y-axis beams 4. The terminal insertion head 5 and the connector holding unit 6 are slidably engaged with the guide rail 15 by LM guides 16 and 17. On both ends of the Y-axis beam 4, servo motors 18 and 19 are provided for driving the terminal insertion head 5 and the connector holding unit 6. Timing belts 21 and 22 are engaged with pulleys 20 of the servo motors 18 and 19, respectively. The one timing belt 21 and the other timing belt 22 individually drive the terminal insertion head 5 and the connector holding head 6 in the Y-direction, respectively.

The terminal insertion head 5 and the connector holding unit 6 and their driving mechanism have been proposed in JP-A-7-190578 and JP-A-7-203344. In this embodiment, as shown in FIG. 1, the terminal insertion head 5 is attached to each of the pair of Y-axis beams 4. For this reason, both terminal ends (each including the terminal 25 and the wire 26 successive thereto) of a single terminal-equipped wire (circuit) 24 are caught by the terminal insertion heads 5 so that the terminals 25 can be moved toward and inserted into the connector housings 7. The number of the terminal insertion heads 5 should not be limited to two (one pair) but may be an even number (plural pairs) so that both terminal ends of the terminal-equipped wire (circuit) 24 can be processed for their movement and insertion for the connector housing.

As shown in FIG. 2, the terminal insertion head 5 includes front and rear catching pieces 27, 28 for catching the wire 26 successive to the terminal, a primary cylinder 38 for moving both catching pieces 27 and 28 simultaneously in a horizontal direction, a secondary cylinder 39 for individually moving the rear catching piece 28, a vertical cylinder 29 for vertically moving both catching pieces 27, 28 together with the cylinders 38, 39 and a pair of thrusting guide pieces 30 for thrusting the wires 26 introduced from the connector housing 7 ahead of the catching piece 27.

Both terminal ends of each of the plurality of terminal-equipped wires 24 are caught by a plurality of clips 32 on a high speed transporting belt 31 and separately arranged as shown in FIG. 1. A plurality of base jigs 33 (FIG. 2) are secured on the base pallet 8. A connector receiving jig 34 is removably engaged with each base jig 33. The connector housing 7 is held in the connector receiving jig 34. The connector holding unit 6 has a chuck 35 for removing the connector receiving jig 34 which is movable vertically from the base jig 33.

Figure 3:
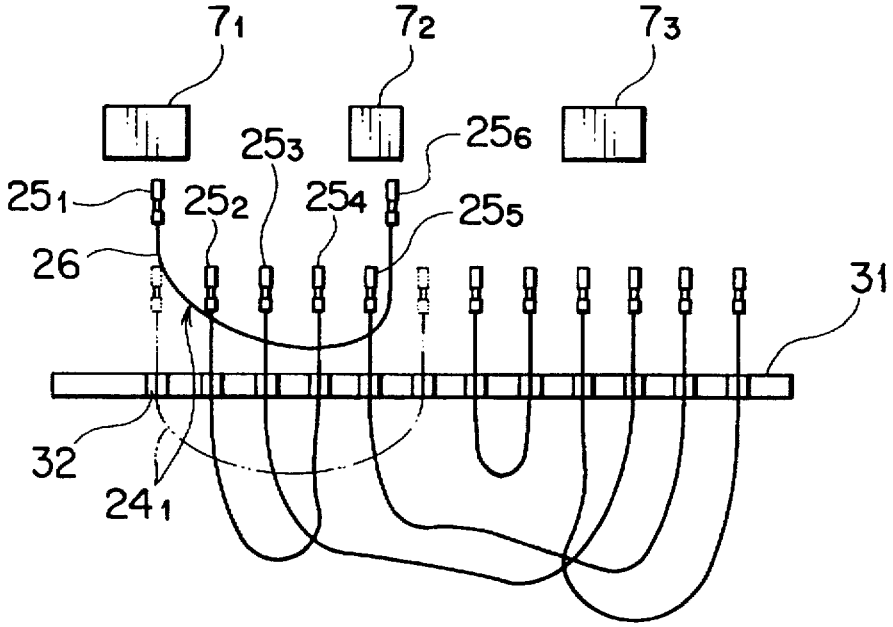
FIG. 3 is a plan view showing the manner of moving both terminal ends of a terminal-equipped wire to be inserted into a connector housing(s)

The two terminal insertion heads 5 catch each of the terminal ends of the wire (circuit) 24 from each of the clips on the transfer belt and lift them. As shown in FIG. 3, the insertion heads 5 advance simultaneously and insert the terminals 25 into connector housings $7_1$ and $7_2$, respectively. In this case, the insertion heads 5 insert the terminals of the terminal ends into not the same connector housing but two separate connector housings (e.g. $7_1$ and $7_2$). Namely, the terminal insertion heads 5 share nearby connector housings. This can reduce the horizontal movement of the terminal insertion heads 5 for the connector housing 7, thus reducing the time required therefor. Since both terminals are caught and advanced simultaneously, unlike the prior art, the wire will not be hooked over the clip and stretched. Thus, even a short terminal-equipped wire (circuit) $24_1$ can be automatically inserted.

The transporting belt 31 can shift a required terminal end near to the connector housing 7 at a high speed. Incidentally, when the terminal 25 is to be inserted, the receiving jig 34 is caught by the chuck so that the connector housing 7 is located ahead of the wire thrusting pieces 30. After terminal insertion is completed, the connector housing 7 is returned to base jig 33 together with the receiving jig 34 by the chuck 35 (see FIG. 2).

Figure 4:
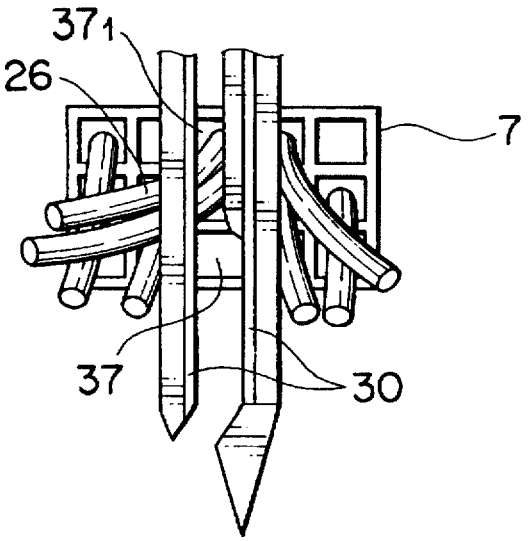
FIG. 4 is a front view of the manner of assuring a required terminal chamber of the connector housing by a wire thrusting piece.

In terminal insertion, as shown in FIG. 4, the wire thrusting pieces 30 thrust the introduced wires 26 around a required terminal chamber 37 of the connector housing 7. Therefore, even after the terminal is inserted into the upper chamber $37_1$, it can be surely inserted into the lower chamber 37. Thus, the terminal 25 can be inserted into a required chamber 37 at random. Unlike the prior art, the terminal ends may not be rearranged in an arrangement order of clips. Further, it is important that the terminals $25_1$ and $25_2$ of both terminal ends of the single wire 24 can be simultaneously inserted into the connector housings $7_1$ and $7_2$ at random. In the prior art, in FIG. 3, the terminals $25_4$ and $25_5$ must be inserted into the connector housing $7_2$ in order before the terminal $25_6$ is inserted. In accordance with the present invention, no limitation is given for the length of a wire so that as shown in FIG. 1, plural connector housings 7 and many circuits 24 can be developed in a shape of wire harness on the base pallet 8.

Incidentally, unless the terminal insertion heads are not interfered with each other, the terminals 25 of both terminal ends can be inserted simultaneously in the connector housing 7. Since the terminals can be inserted at random, as long as the wire is relatively long, using a single insertion head 5, the one terminal 25 of the wire 24 (circuit) can be inserted and thereafter the other terminal 25 thereof can be inserted.

Figure 5:
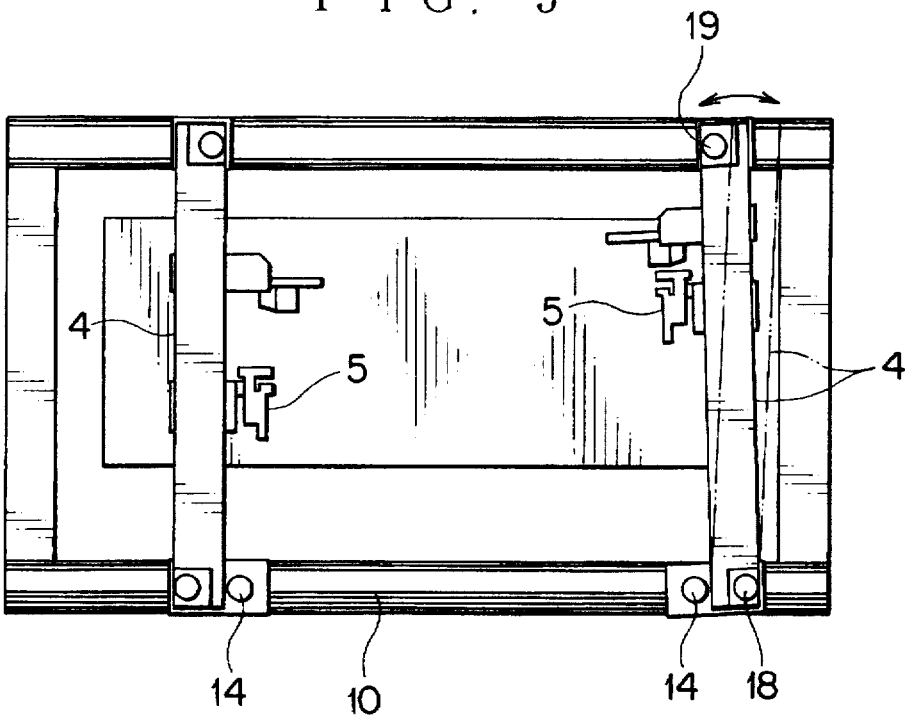
FIG. 5 is a plan view showing the state where the Y-axis beam of the terminal insertion apparatus.
Figure 6:
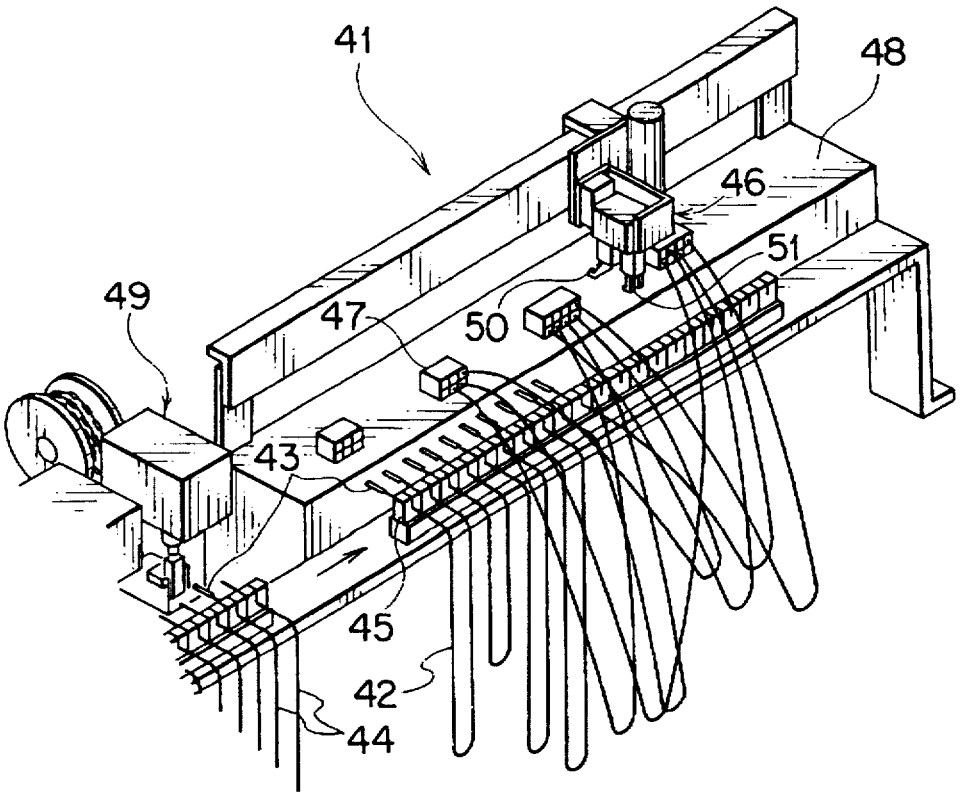
FIG. 6 PRIOR ART
FIG. 6 is a perspective view of a prior art terminal insertion apparatus.
Figure 7:
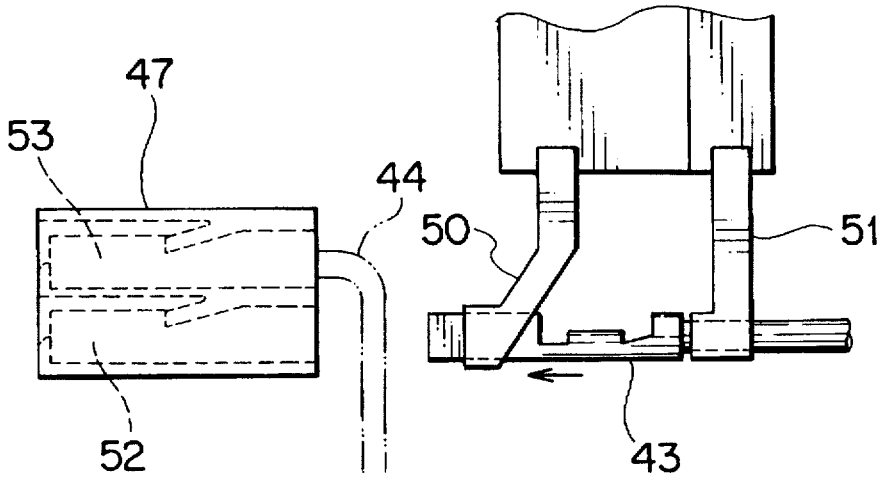
FIG. 7 PRIOR ART
FIG. 7 is a side view of the state where a terminal is inserted into a connector housing.
Figure 8:
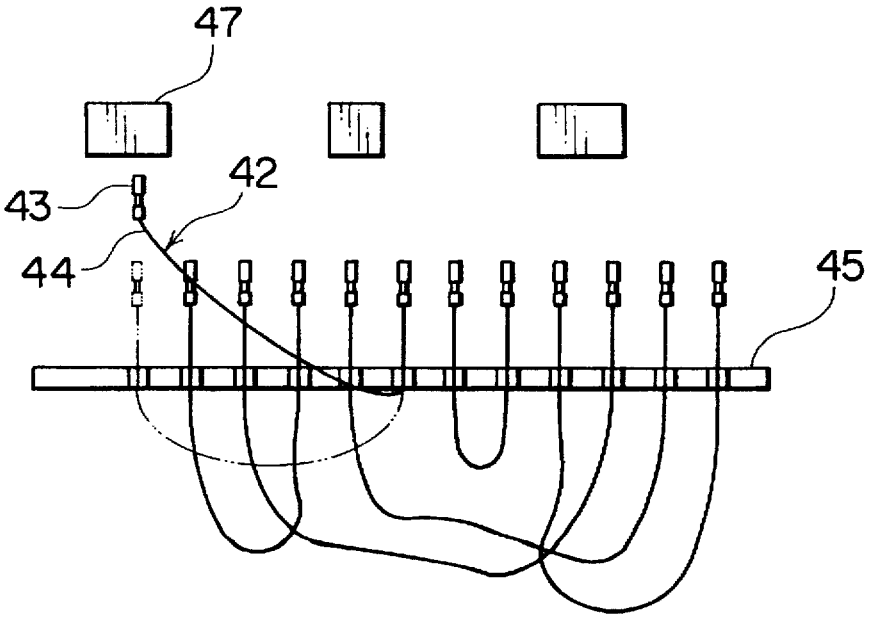
FIG. 8 PRIOR ART
FIG. 8 is a plan view for explaining the problem encountered when a short terminal-equipped wire is automatically inserted.

As described above, the two insertion heads 5 can approach the connector housings 7 by the horizontal movement of the two Y-axis beams (movement along the X-axis beams 3) as shown in FIG. 1. In this case, the Y-axis beams 4 can be driven smoothly with no positional deviation in such a manner that the pinions 13 of the driving motors 14 provided at both ends are toothed with the respective racks 10 of the X-axis rails 3. On other hand, when the driving motors 14 is provided at only the one end of the Y-axis beam 4 as shown in FIG. 5, the Y-axis beam 4 may tilt or may be pinched to vibrate during motor driving. The vibration of the Y-axis beam will be propagated to the insertion head 5 to make the terminal insertion inaccurate.

In order to obviate such inconvenience, in accordance with the present invention, both ends of the Y-axis beam 4 is driven by the driving motors 14. Thus, the position of the terminal insertion head 5 can be defined accurately with no vibration so that the terminal 25 can be surely inserted into the connector housing 7. Further, since the Y-axis beam 4 is not subjected to overload due to e.g. pinching, the Y-axis beam 4 can be driven by the necessary and minimum number of motors and so driven at a high speed.

What is claimed is:

1. A method of inserting a terminal in a connector housing comprising the steps of:

picking out both terminal ends of each of terminal-equipped wires held by a plurality of clips by a pair of terminal insertion heads individually driven in both a Y-axis direction and an X-axis direction; and simultaneously moving both terminal ends of each wire into said connector housing.

2. A method of inserting a terminal according to claim 1, wherein both of said terminal ends are simultaneously picked out.

3. A method of inserting a terminal according to claim 1, further comprising the step of inserting the terminals of both terminal ends into different connector housings.

4. A method of inserting a terminal comprising the steps of:

picking out both terminal ends of each of terminal-equipped wires held by a plurality of clips by a pair of terminal insertion heads individually driven;

simultaneously moving both terminal ends of each wire; and inserting the terminals of both terminal ends into a common connector housing.

5. A terminal insertion apparatus comprising:

at least one Y-axis beam moving along a pair of X-axis beams each having a rack;

a terminal insertion head attached to said Y-axis beam;

a pair of driving motors, each having a pinion toothed with said rack, provided at both ends of said Y-axis beam so that they are driven synchronously to move said Y-axis beam.

6. A terminal insertion apparatus according to claim 5, wherein a pair of Y-axis beams are provided, and a pair of terminal insertion heads are arranged in said pair of Y-axis beams correspondingly.

7. A terminal insertion apparatus according to claim 5, wherein a pair of Y-axis beams are provided, and plural pairs of terminal insertion heads are arranged in said pair of Y-axis beams correspondingly.

8. A terminal insertion apparatus comprising:

a pair of Y-axis beams moving along a pair of X-axis beams; and a pair of terminal insertion heads correspondingly attached to said pair of Y-axis beams and individually driven.

* * * * *

UNITED STATES PATENT AND TRADEMARK OFFICE

CERTIFICATE OF CORRECTION

PATENT NO.: 5,774,981
DATED : July 7, 1998
INVENTOR(S): MAEJIMA et al.

It is certified that error appears in the above-identified patent and that said Letters Patent is hereby corrected as shown below:

Title page, item
[30] Please change the priority date to --November 7, 1995--

Signed and Sealed this

First Day of December, 1998

Bruce Lehman

*Attest:*

BRUCE LEHMAN

*Attesting Officer*

*Commissioner of Patents and Trademarks*